US010022004B2

(12) United States Patent
Taormina et al.

(10) Patent No.: US 10,022,004 B2
(45) Date of Patent: Jul. 17, 2018

(54) DRINK LID

(71) Applicant: Tini Topper Brands, LLC, Philadelphia, PA (US)

(72) Inventors: Paul Taormina, Philadelphia, PA (US); Suzann Taormina, Philadelphia, PA (US); Francesco Taormina, Philadelphia, PA (US); Frankie Allison, Los Angeles, CA (US)

( * ) Notice: Subject to any disclaimer, the term of this patent is extended or adjusted under 35 U.S.C. 154(b) by 0 days.

(21) Appl. No.: 14/669,671

(22) Filed: Mar. 26, 2015

(65) Prior Publication Data

US 2016/0278555 A1 Sep. 29, 2016

(51) Int. Cl.

| | |
|---|---|
| ***B65D 43/04*** | (2006.01) |
| ***A47G 19/23*** | (2006.01) |
| ***A47G 19/22*** | (2006.01) |
| ***B65D 25/28*** | (2006.01) |
| ***B65D 81/36*** | (2006.01) |
| ***B65D 43/02*** | (2006.01) |

(52) U.S. Cl.

CPC ..... *A47G 19/23* (2013.01); *A47G 19/2205* (2013.01); *A47G 19/2272* (2013.01); *B65D 25/28* (2013.01); *B65D 43/0222* (2013.01); *B65D 81/366* (2013.01); *B65D 2525/283* (2013.01); *B65D 2543/00027* (2013.01); *B65D 2543/00092* (2013.01); *B65D 2543/00296* (2013.01); *B65D 2543/00527* (2013.01); *B65D 2543/00537* (2013.01); *B65D 2543/00851* (2013.01)

(58) Field of Classification Search

CPC ..... A47G 19/23; A47G 19/2272; B65D 43/0222; B65D 81/366; B65D 25/28; B65D 2543/00851; B65D 2543/00092; B65D 2543/00296; B65D 2543/00527; B65D 2543/00537; B65D 2543/00027; B65D 2525/283

USPC .... 220/212.5, 796, 805, 200, 729, 780, 795, 220/578; 427/272; 116/63 C; 215/355

See application file for complete search history.

(56) References Cited

U.S. PATENT DOCUMENTS

| | | | | |
|---|---|---|---|---|
| 2,177,359 A | | 10/1939 | Baker | |
| 2,333,273 A | * | 11/1943 | Scanlon | E01F 9/612 116/200 |
| 2,997,788 A | | 8/1961 | Gilbert | |
| 5,064,296 A | * | 11/1991 | Huijsing | G01F 1/68 374/163 |
| 5,176,269 A | | 1/1993 | Herman | |

(Continued)

*Primary Examiner* — James N Smalley

(74) *Attorney, Agent, or Firm* — Ryder, Lu, Mazzeo & Konieczny LLC; Joseph M. Konieczny, Sr.; Gregory J. Gore

(57) ABSTRACT

A beverage lid for temporarily and removeably covering beverage cups and glasses to prevent spillage and contamination. The lid is installed on a drinking glass having an enlarged reservoir with a circular rim. The lid has a circular, planar base with an outer surface, an inner surface, and a diameter larger than the diameter of the glass rim. A central handle is affixed at a proximal end to and projects from the base and has an outer, grasping surface and an inner surface. The handle preferably has a shape that allows the outer surface of one handle to nest in the inner surface of the handle of another of the lids. The lid preferably includes an annular lip or tabs that project transverse to the plane of the base to prevent the lid from sliding off the rim of the glass.

12 Claims, 8 Drawing Sheets

(56) References Cited

U.S. PATENT DOCUMENTS

| | | | | |
|---|---|---|---|---|
| 5,328,723 | A * | 7/1994 | Horiki | B05B 15/0462 118/504 |
| 5,402,908 | A * | 4/1995 | Warden | A47J 47/02 220/529 |
| 5,531,347 | A | 7/1996 | Goulding | |
| D450,979 | S * | 11/2001 | Nestro | D7/392.1 |
| 6,647,284 | B1 * | 11/2003 | Lee | G01J 5/021 374/158 |
| 7,017,768 | B2 | 3/2006 | Iskierka | |
| D609,972 | S | 2/2010 | Reeser et al. | |
| D663,574 | S * | 7/2012 | Shenkal | D7/392.1 |
| 8,613,417 | B2 | 12/2013 | Kraus | |
| 2006/0226163 | A1 | 10/2006 | Redshaw | |
| 2007/0158356 | A1 * | 7/2007 | Cunningham | A47G 19/2205 220/801 |
| 2008/0000898 | A1 | 1/2008 | Ramsden | |
| 2008/0041868 | A1 | 2/2008 | Gonyea | |
| 2008/0190945 | A1 * | 8/2008 | Milnark | A47G 19/2211 220/709 |
| 2008/0302802 | A1 | 12/2008 | Ramsden | |
| 2009/0152272 | A1 * | 6/2009 | Guptil | A47G 19/2211 220/361 |
| 2010/0116698 | A1 | 5/2010 | Sudhakar et al. | |
| 2011/0233226 | A1 * | 9/2011 | Muxo | B65D 43/0214 220/796 |
| 2012/0061395 | A1 * | 3/2012 | Imo | B65D 51/08 220/376 |
| 2012/0091142 | A1 * | 4/2012 | Jamison | A47G 19/2222 220/371 |

* cited by examiner

DRINK LID

FIELD OF THE INVENTION

The present invention relates to devices for temporarily and removeably covering beverage cups and glasses to prevent spillage and contamination.

BACKGROUND OF THE INVENTION

Martinis are a well-known adult beverage, which are served in bars and restaurants throughout the world. Martinis are preferably served in a specially-shaped glass known as a "martini glass", which has an inverted-conical-shaped reservoir and a very thin stem. It is believed that the martini glass (sometimes equated with the cocktail glass of similar shape but smaller size) was designed to uniquely compliment the physical and chemical properties of a martini. For example, martinis are typically served "up", i.e., chilled but without ice. The lengthy stem and separated reservoir prevent the liquid contents ("beverage") from being warmed via contact with the patron's hand. The extra-wide upper reservoir creates greater surface area for exposing the beverage to air, which enables the spirits within the beverage to "open up" and makes the botanicals within the beverage more discernible than they would be if the beverage was served in a narrower glass. The steeply sloping sides of the reservoir also act as a mixing aid to prevent the beverage's ingredients from separating. Finally, the sloping sides help support beverage garnish and accouterments such as a toothpick or cocktail skewer of olives, which are typically served with the martini.

Over the years, the iconic silhouette of the martini glass has become synonymous with sophistication and style; however, for most waiters, waitresses and patrons, the martini glass is deficient in at least one way. Due to its height and enlarged, inverted-conical-shaped reservoir, the contents of martini glasses spill easily during transport from the bartender to the patron. Spillage during transport can create a mess on the server tray and create a slip hazard on the restaurant/bar floor. Spillage during transport can also create a poor customer experience due to a reduction in the volume of beverage received for a typically pricey drink. Therefore, it would be desirable to provide a means for preventing spillage of the contents of a martini glass during transport from the bartender to the patron.

For many years, there have been reports of bar patrons being unknowingly drugged by a criminal predator who stealthily contaminates a patron's (typically a woman's) cocktail with an illicit substance. Patron's often leave their drink unattended to use the restroom, operate the jukebox, play pool or darts, or dance. Even while the drink is being attended by the patron, in a crowded bar with many distractions, a criminal's sleight of hand is often difficult to detect. In recent years, the proliferation and ease of access to a variety of designer drugs has caused such criminal acts to increase dramatically. Therefore, it would be desirable to provide a means for reducing the ease with which a criminal can contaminate a patron's cocktail.

Like most crowded public areas, bar and restaurants provide fertile grounds for spreading airborne illnesses when someone sneezes or coughs. The proximity with which patrons are seated at bars and restaurant tables enables respiratory droplets expelled from a sick person to land in the drink of a nearby patron. Other contaminants, such as insects or cleaning volatiles, may also land in a patrons drink if it has an open top. Therefore, it would be desirable to provide a means for reducing the ease with which a patron's cocktail can be contaminated from airborne contaminants.

Patrons at restaurants and bars can be described as a captured audience from an advertising perspective. While sitting at the bar or table, the patron is typically exposed to surrounding advertising in many forms. Bar and restaurant owners often capitalize on this environmental condition by hanging signs, lights and posters that advertise particular beer or liquor brands. Bar and restaurant owners also provide advertising medium in close proximity to the patrons such as drink coasters, straw ads, and table placards. To increase profitability, it would be desirable to provide a drink lid, which provides one or more of the functions described above and which serves as a medium for advertising material.

SUMMARY OF THE INVENTION

The present invention relates to devices for temporarily and removeably covering beverage cups and glasses to prevent spillage and contamination. In preferred embodiments, the lid is stackable and particularly designed for martini glasses and pint glasses.

In a preferred embodiment, the lid a circular, planar base with an outer surface, an inner surface, and a diameter larger than the diameter of the glass. The lid also includes a central handle affixed at a proximal end to and projecting from the base. The handle has an outer, grasping surface and an inner surface. The handle has a shape that allows the outer surface of one handle to nest in the inner surface of the handle of another of the lids.

Preferably, the outer surface of the handle is integrally formed with the outer surface of the base, and the inner surface of the handle is integrally formed with the inner surface of the base. However, in other embodiments, the base of the lid includes a central axial bore and the handle is affixed to the perimeter of the bore and extends axially from the bore. Alternatively, the base may include a nub extending axially from the center of the base, and means for connecting the handle to the nub.

In one preferred embodiment, the lid includes an annular lip on the inner surface of the base that projects transverse to the plane of the base. The lip may have a hemispherical cross-section and be located on the outer circumference the base. In alternative embodiments, the lid has a plurality of axially-extending tabs instead of an annular lip. The tabs have a distal end and proximal end fixed to the edge of the base. In a further preferred embodiment, the tabs include a radially-extending ear on the distal end of each tab, and a secondary handle fixed to the base.

In another preferred embodiment, the lid has a central axis extending through the center perpendicular to the plane of the base, and the outer edge of the base has a flat, tapered surface that extends outwardly such that the diameter of the outer surface of the base is larger than the diameter of the inner surface. In yet another preferred embodiment, decorative garnish is affixed to a distal end of the handle.

The base may include a plurality of concavities in the outer surface in which fruit garnish or accouterments can be stored. The base may also include a cut-out proximate the outer edge through which a toothpick can extend. The base may also include a small bracket protruding radially from the outer edge. In this embodiment, the bracket includes a pair of deflectable forks that straddle and support a toothpick.

In yet an additional embodiment of the invention, the base comprises a digital compact disc and the handle comprises a button removeably fixed in the central bore of the compact disc. The compact disc may contain advertising, music, videos or any combination thereof. Any of the other embodiments may also included advertising imprinted, labeled or embossed thereon.

The lid is preferably made from a rigid material. However, in an alternative embodiment, the base is flexible and can be depressed by applying an axial force to the central handle.

In yet another embodiment, the invention comprises a drink set including a drinking glass and a lid. The drinking glass has a base, an enlarged, inverted-conical-shaped reservoir with an upper rim, and an elongate stem connecting the reservoir to the base. The drink lid has a circular planar base including an outer surface and an inner surface. The drink lid also has a central handle projecting from the base, which has an outer, grasping surface and an inner surface. The handle has a shape that allows the outer surface of one handle to nest in the inner surface of the handle of another of the lids.

In one embodiment, the lid has a diameter greater than the diameter of the glass rim. In another embodiment, the lid base has a flat, tapered edge surface that extends upwardly outwardly relative to a central axis extending perpendicularly through the center of the lid. In this embodiment, the diameter of the edge surface is slightly smaller than the inner diameter of the glass. Preferably, the angle of the taper of the edge surface relative to the central axis approximates the angle formed between the inner surface of the glass reservoir and the stem of the glass.

DETAILED DESCRIPTION OF PREFERRED EMBODIMENTS

Figure 1:
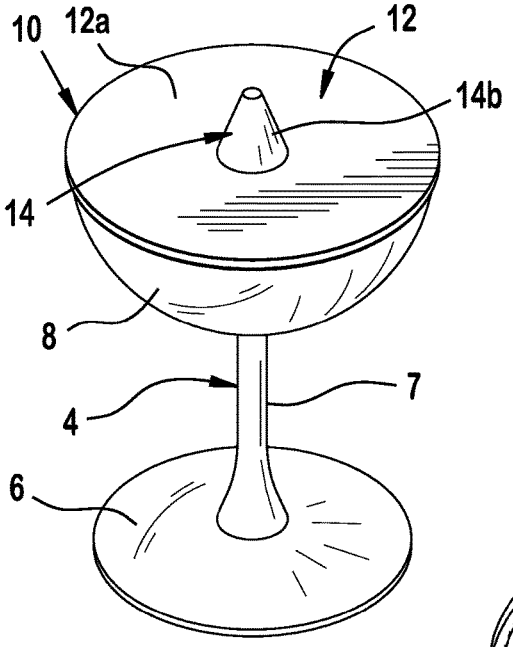
FIG. 1 is a perspective view of an apparatus in accordance with a first preferred embodiment of the invention installed on a martini glass.
Figure 2:
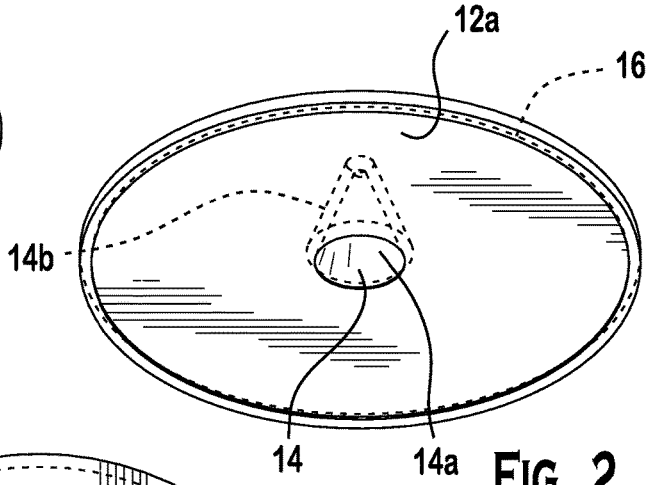
FIG. 2 is an enlarged perspective view of the apparatus of FIG. 1.
Figure 3:
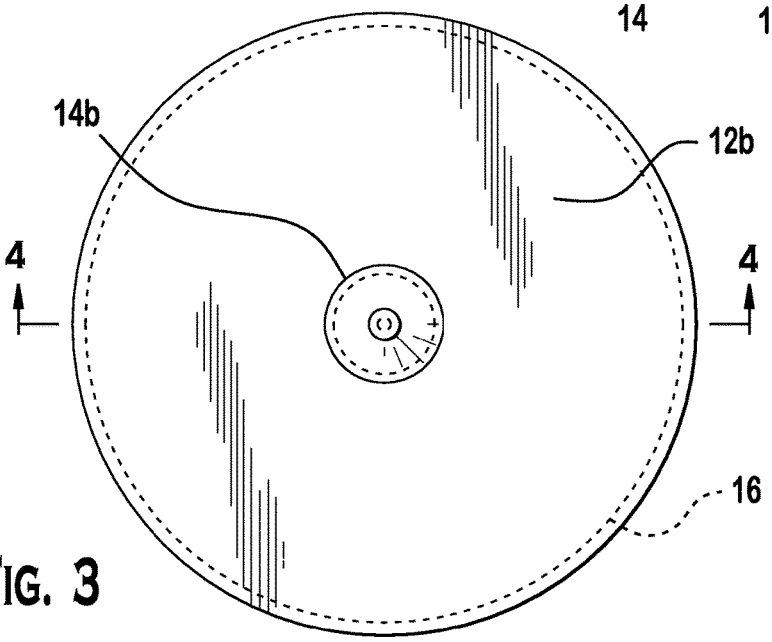
FIG. 3 is a top plan view of the apparatus of FIG. 1.
Figure 4:
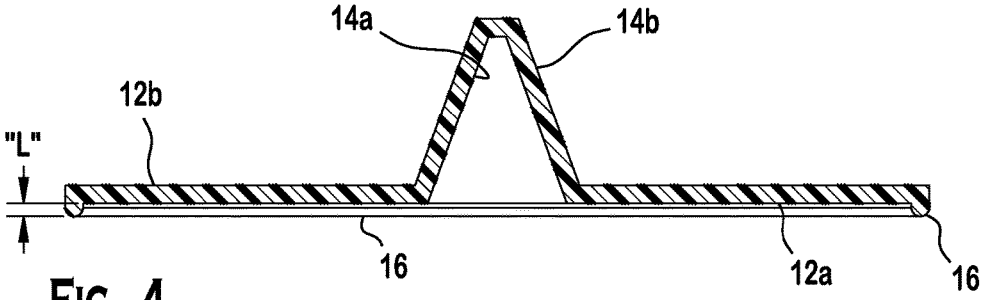
FIG. 4 is a cross-sectional view taken along lines 4-4 of FIG. 3.

For the purpose of illustrating the invention, numerous preferred embodiments are shown in the accompanying drawings. However, it should be understood by those of ordinary skill in the art that the invention is not limited to the precise arrangements and instrumentalities shown therein and described below. Throughout the specification, like reference numerals are used to designate like elements. Numerous changes and modifications within the spirit and scope of the invention will become apparent to those skilled in the art from this detailed description. Unless otherwise defined, all terms used herein in their various grammatical forms have the same meaning as commonly understood by one of ordinary skill in the art to which this invention belongs.

A drink lid in accordance with a preferred embodiment of the invention is illustrated in FIGS. 1-6 and is designated generally by reference numeral 10. The lid 10 is shown installed on a common martini glass 4 having a base 6, an elongate stem or handle 7, and an enlarged, inverted-conical-shaped reservoir 8 with an upper rim 9.

The lid 10 has a flat, circular base 12, a central handle 14, and an annular lip 16 on the outer perimeter of the base 12.

The base 12 is preferably very thin relative to its diameter and has an inner surface 12*a*, which faces downwardly towards the beverage within the glass, and an outer surface 12*b* that faces upwardly towards the user. The base is preferably rigid.

Figure 5:
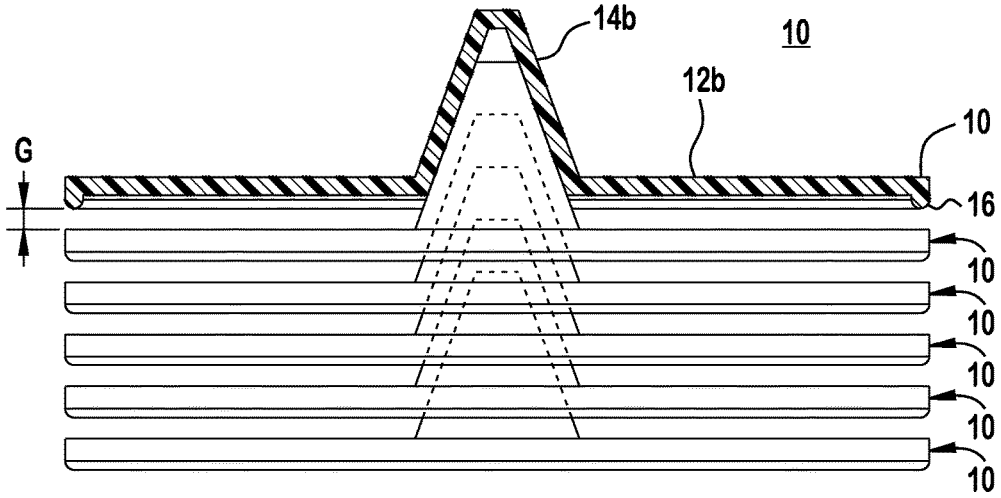
FIG. 5 is a cross-sectional view of the apparatus of FIG. 1 shown stacked on a plurality of similar apparatus.
Figure 6:
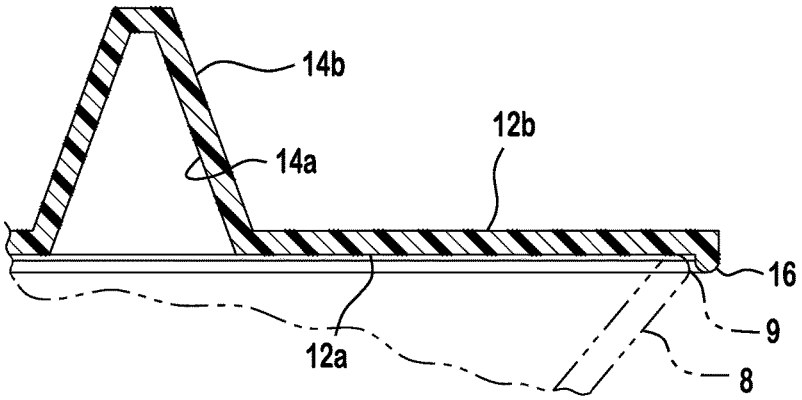
FIG. 6 is a fragmentary, enlarged, cross-sectional view showing the apparatus of FIG. 1 installed on the rim of a martini glass.

The handle 14 has inner surface 12*a* that faces downwardly towards the beverage, and an outer gripping surface 12*b* that faces upwardly towards the user. In this embodiment, the handle 14 has a conical shape whose diameter reduces progressing upwardly transverse to the plane of the base 12. This conical shape enables the outer surface 14*b* to be nested within the inner surface 14*a* of the handle of another lid when the lids are stacked as best seen in FIG. 5. Other nestable handle shapes are within the scope of this embodiment of the invention, including the shape shown on FIG. 28-30.

The lip 16 has a hemispherical cross-section and projects downwardly from the inner surface 12*a* of the base 12. The lip 16 need only project a short distance "L" from the inner surface 12*a* of the base 12 in order to prevent the lid from sliding off the rim 9. The lip 12 of this embodiment is hemispherical for ease of manufacturing but other lip profiles are within the scope of this embodiment.

Because the base 12 is generally flat, and because the handle 14 has a nestable shape, the lids 10 can be stacked for compact storage as best seen in FIG. 5. Preferably, the thickness of the handle creates a gap "G" between abutting adjacently-stacked lids so that the lids can be more easily separated from the stack by inserting an object or finger into the gap.

In this embodiment, the base 12, handle 14 and lip 16 are integrally formed from the same material so that the handle and lid inner surfaces and outer surfaces, respectively, are continuous. To achieve this construction, the lid may be molded or formed from known rigid polymers.

In this embodiment, the lid 10 simply rests on the rim 9 of the glass 8 and inhibits spillage. The lid 10 is not screwed on or otherwise fastened to the glass. A weak seal is formed by the weight of the lid and surface tension between the moistened glass rim 9 and the base 12 of the lid 10. During installation, the lip 16 insures that the lid 10 is properly centered on and covers the entire rim 9, and prevents the lid from sliding off the rim 9.

Figure 7:
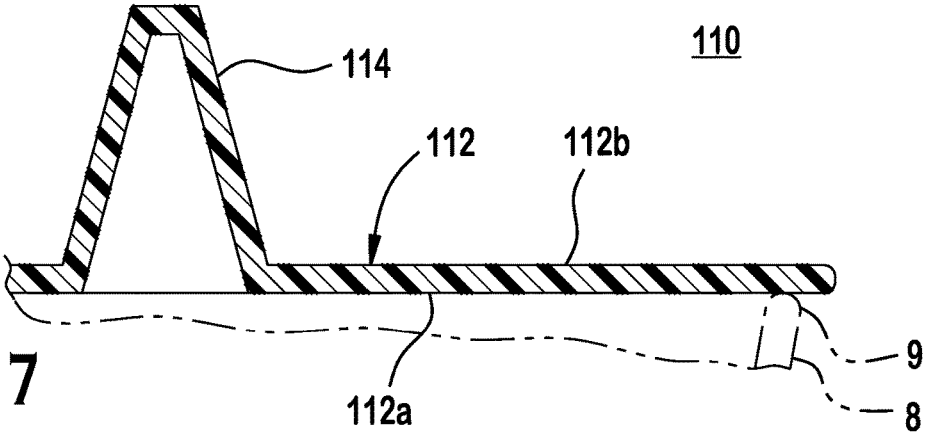
FIG. 7 is a fragmentary, enlarged, cross-sectional view showing an apparatus in accordance with another preferred embodiment of the invention installed on the rim of a martini glass.

A drink lid in accordance with another preferred embodiment of the invention is illustrated in FIG. 7 and is designated generally by reference numeral 110. The lid 110 has a flat, circular base 112 and a central handle 114 similar to the base 12 and handle 14 of FIGS. 1-6; however, in this embodiment, the lid 110 does not include an annular lip. Instead, the circumference of the inner surface 112*a* is similar to the circumference of the outer surface 112*b*.

Figure 8:
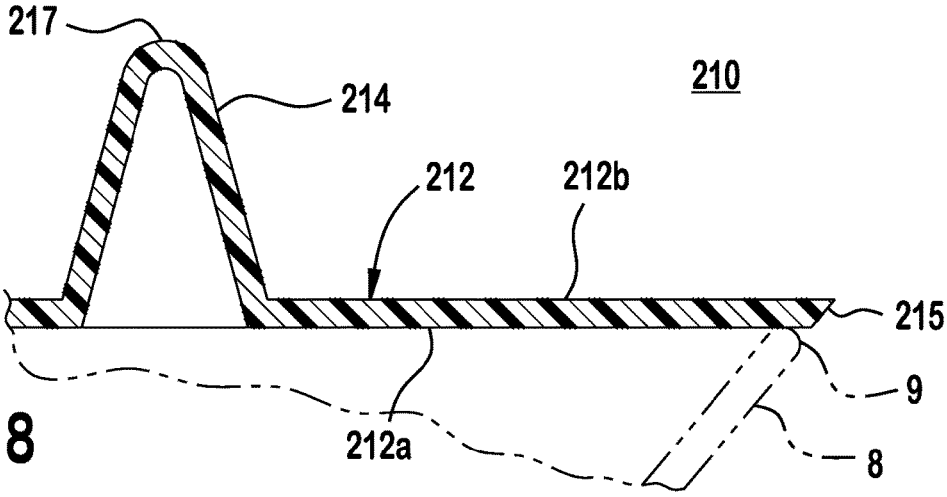
FIG. 8 is a fragmentary, enlarged, cross-sectional view showing an apparatus in accordance with an additional preferred embodiment of the invention installed on the rim of a martini glass.

A drink lid in accordance with another preferred embodiment of the invention is illustrated in FIG. 8 and is designated generally by reference numeral 210. The lid 210 has a flat, circular base 212 and a central handle 214 similar to the base 112 and handle 114 of FIG. 7; however, in this embodiment, the edge of the base 212 has a flat, tapered surface 215 and the distal end 217 of the handle 214 is rounded for ease of production. Relative to a central axis extending perpendicularly through the center of the lid, the surface 215 extends upwardly outwardly such that the diameter of the outer surface of the base 212*b* is slightly larger than the diameter of the inner surface 212*a*. The angle of the taper relative to the central axis approximates the angle formed between the inner surface of the reservoir 8 and the stem 7 of the martini glass 4.

Figure 9:
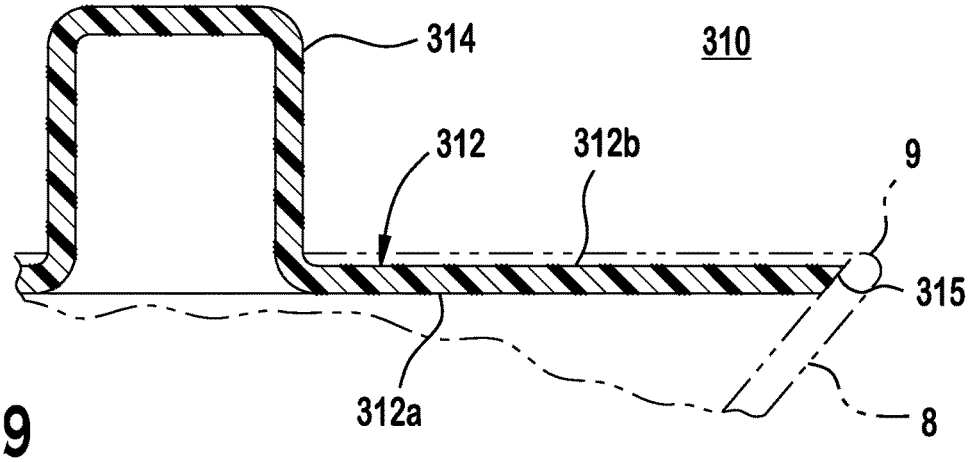
FIG. 9 is a fragmentary, enlarged, cross-sectional view showing an apparatus in accordance with a further preferred embodiment of the invention installed on the interior surface of the reservoir of a martini glass.

A drink lid in accordance with a further preferred embodiment of the invention is illustrated in FIG. 9 and is designated generally by reference numeral 310. The lid 310 has a flat, circular base 312 similar to the base 212 of the embodiment shown in FIG. 8; however, in this embodiment, the handle 314 has a cylindrical shape with constant-diameter side walls as best seen in FIG. 9. The cylindrical shape makes the handle 314 easier to grasp but is not nestable with the handle of another lid.

In this embodiment, the edge of the base 312 has a flat, tapered surface 315 similar to the embodiment shown in FIG. 8. However, in this embodiment, the diameter of the upper outer surface 312*b* is slightly smaller than the inner diameter of the martini glass reservoir 8 with which the lid 310 is intended to be used. The lid 310 sits in the reservoir 8 with its peripheral edge flatly abutting the inner surface of the reservoir 8. Because lateral movement of the lid 310 is restrained by the glass, the lid 10 is more securely installed on the martini glass 4.

Figure 10:
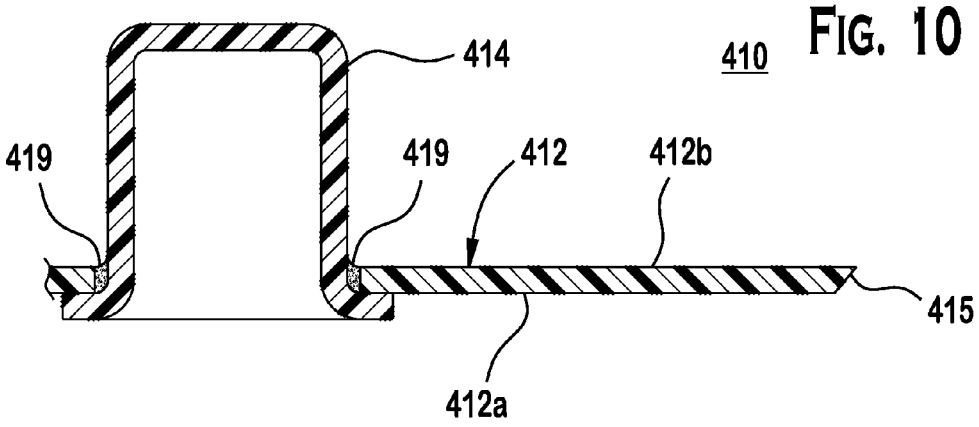
FIG. 10 is a fragmentary, enlarged, cross-sectional view of an apparatus in accordance with yet another preferred embodiment of the invention.

A drink lid in accordance with another preferred embodiment of the invention is illustrated in FIG. 10 and is designated generally by reference numeral 410. The lid 410 has a flat, circular base 412 similar to the base 212, 312 of the embodiments shown in FIGS. 8 and 9 and a handle 414 similar to the handle shown in FIG. 9; however, in this embodiment, the handle 414 is not integrally formed with the base. Instead, the handle 414 comprises a separate component that is permanently fixed to the base 414 by a fastening substance 419 such as by an adhesive or a weld.

In this embodiment, the edge of the base 412 has a flat, tapered surface 415 similar to the edge surfaces of the embodiments shown in FIGS. 7 and 8. Relative to a central axis extending perpendicularly through the center of the lid, the surface 415 extends upwardly outwardly such that the diameter of the outer surface of the base 412*b* is slightly larger than the diameter of the inner surface 412*a*. The angle of the taper relative to the central axis approximates the angle formed between the inner surface of the reservoir 8 and the stem 7 of the martini glass 4.

Figure 11:
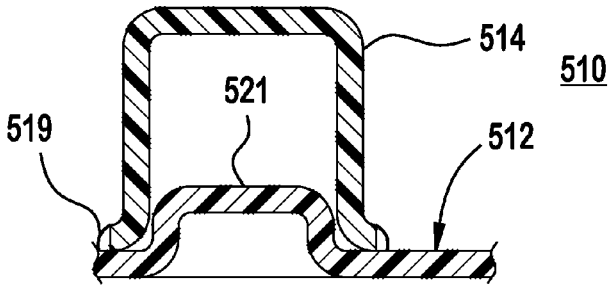
FIG. 11 is a fragmentary, cross-sectional view of an apparatus in accordance with an additional preferred embodiment of the invention.
Figure 12:
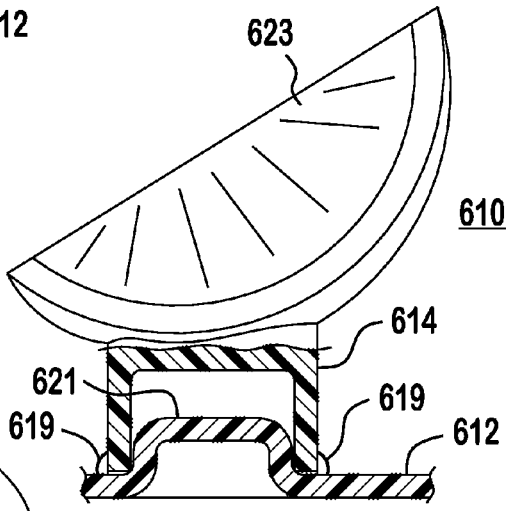
FIGS. 12 and 13 are fragmentary, cross-sectional views of an apparatus in accordance with yet a further preferred embodiment of the invention.
Figure 13:
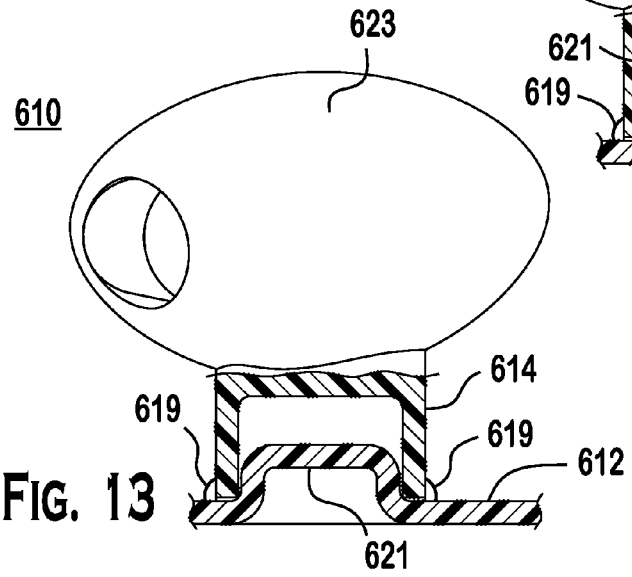

A drink lid in accordance with an additional preferred embodiment of the invention is illustrated in FIG. 11 and is designated generally by reference numeral 510. The lid 510 has a flat, circular base 512 similar to the base 212, 312, 412 of the embodiments shown in FIGS. 8-10 respectively; however, in this embodiment, the handle 514 is not integrally formed with the base. Instead, the handle 514 comprises a separate component that is permanently fixed to a central nub 521, integrally formed with and protruding axially from the center of the base 512. In this embodiment, the handle 514 is affixed to the nub 521 with a fastening substance 519 such as an adhesive or a weld. A drink lid in accordance with a further preferred embodiment of the invention is illustrated in FIGS. 12 and 13 and is designated generally by reference numeral 610. The lid 610 has a cylindrical handle 614, a flat, circular base 612, and an axially-protruding nub 621 similar to the handle 514, base 512 and nub 521, respectively, shown in FIG. 11; however, in this embodiment, a decorative drink garnish 623 is affixed to the distal end of the handle 614. In the embodiment shown in FIGS. 12 and 13, the garnish 623 resembles a fruit slice and olive, respectively. In this embodiment, the handle 614 is affixed to the nub 621 with a fastening substance 619 such as an adhesive or a weld.

Figure 14:
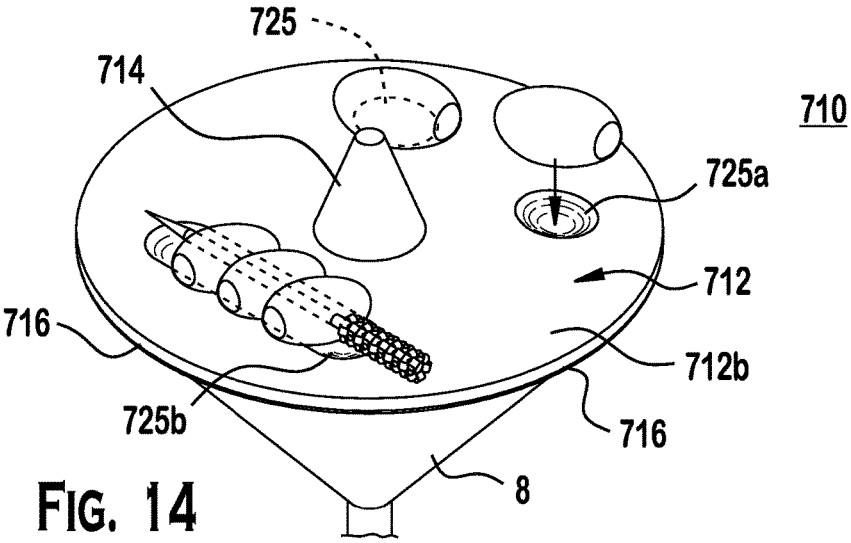
FIG. 14 is a perspective view of an apparatus in accordance with still another preferred embodiment of the invention showing concavities for storing drink accouterments or garnish.

A drink lid in accordance with yet a further preferred embodiment of the invention is illustrated in FIG. 14 and is designated generally by reference numeral 710. The lid 710 has a flat, circular base 712, a central handle 714 and annular lip 716 similar to the base 112, handle 114, and annular lip 116 of FIGS. 1-6. In this embodiment, the base 712 includes a plurality of concavities 725 in the outer surface 712*b* of the base 712. The concavities 725 may have a variety of shapes such as a spherical depression 725*a* or a trough 725*b*. The concavities 725 are preferably arranged in a balanced manner around the handle 714 and are shaped to receive a single or gang of drink garnish such as olives, pearl onions or other drink accoutrement.

Figure 15:
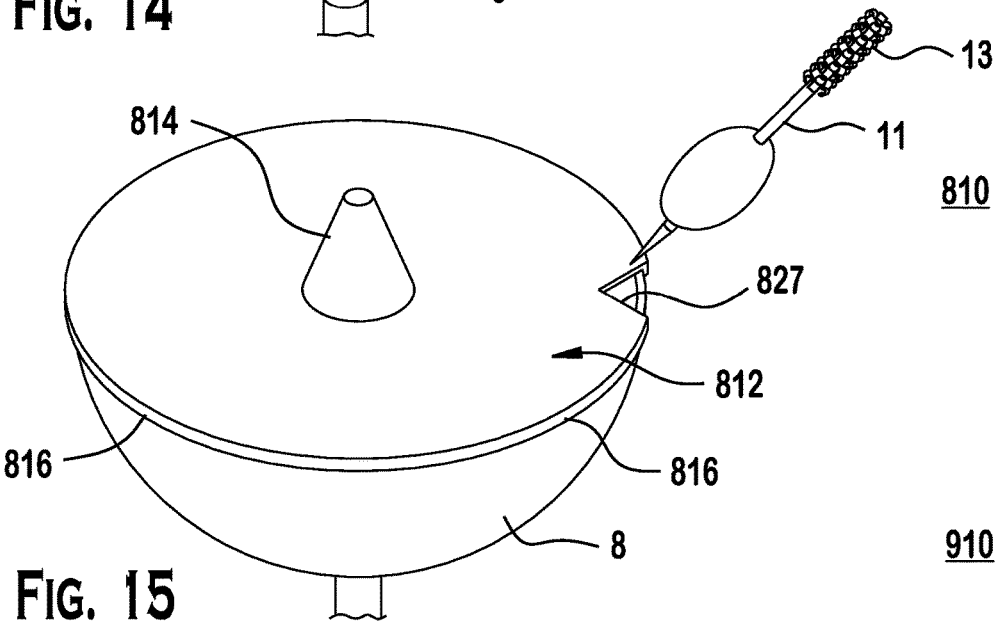
FIG. 15 is a perspective view of still an additional preferred embodiment of the invention having a cutout through which a drink accouterment or garnish may extend.

A drink lid in accordance with still another preferred embodiment of the invention is illustrated in FIG. 15 and is designated generally by reference numeral 810. The lid 810 has a flat, circular base 812, a central handle 814 and annular lip 816 similar to the base 112, handle 114, and annular lip 116 of FIGS. 1-6. In this embodiment, the base 812 includes a small notch or cut-out 827 proximate the outer edge. The size of the notch 827 should be minimized to reduce the amount of spillage if the glass 8 is disturbed. The notch 827 may have any shape but should preferably be large enough so that a toothpick 11 or other drink skewer can extend therethrough. More preferably, the notch 827 should be small enough so that the decorative hand grip 13 on a toothpick 11 or drink skewer will not pass therethrough. In this embodiment, the lid 810 supports the decorative hand grip 13 of the toothpick 11 while simultaneously suspending the drink garnish within the beverage.

Figure 16:
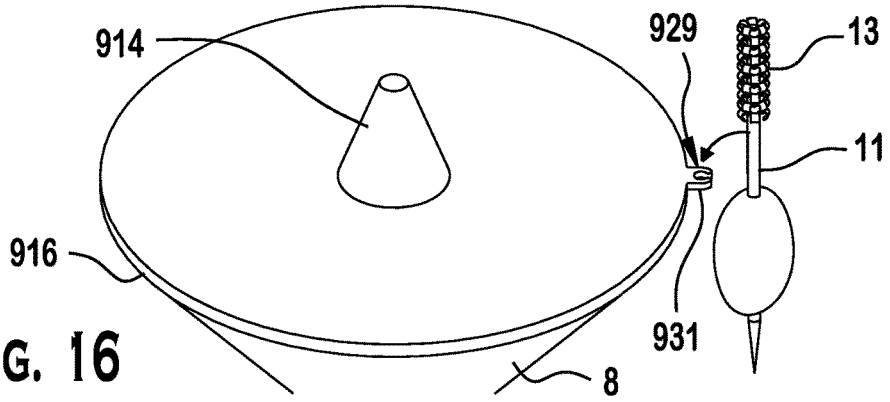
FIG. 16 is a perspective view of still a further preferred embodiment of the invention having a bracket for supporting a drink accouterment or garnish.

A drink lid in accordance with still a further preferred embodiment of the invention is illustrated in FIG. 16 and is designated generally by reference numeral 910. The lid 910 has a flat, circular base 912, a central handle 914 and annular lip 916 similar to the base 112, handle 114, and annular lip 116 of FIGS. 1-6. In this embodiment, the base 912 includes a small bracket 929 protruding radially from the outer edge of the base 912. The bracket has a pair of deflectable forks 931, which straddle and support a toothpick 11 or other drink skewer, which in turn suspends the drink garnish from the lid 910.

Figure 18:
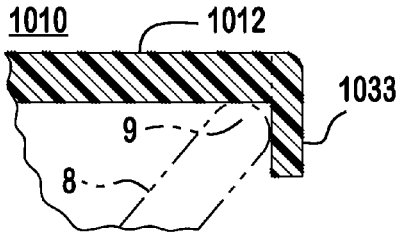
FIG. 18 is a fragmentary, cross-sectional view taken along lines 18-18 of FIG. 17.
Figure 17:
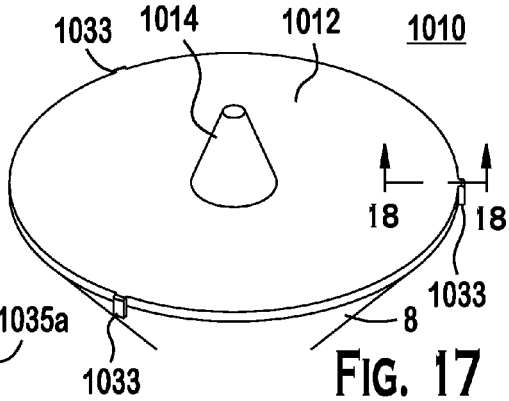
FIG. 17 is a perspective view of another preferred embodiment of the invention having containment clips.
Figure 19:
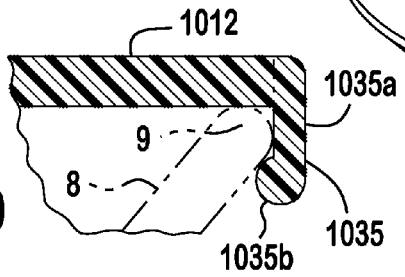
FIG. 19 is a fragmentary, cross-sectional view of an additional preferred embodiment of the invention showing a containment flange.

A drink lid in accordance with still another preferred embodiment of the invention is illustrated in FIGS. 17-19 and is designated generally by reference numeral 1010. The lid 1010 has a flat, circular base 1012 and a central handle 1014 similar to the base 112 and handle 114 of FIGS. 1-6. In this embodiment, the base 1012 includes a plurality of axially-extending tabs 1013 fixed to the edge of the base 1012. The tabs 1033 are preferably spaced equally around the circumference of the base 1012. In the embodiments shown in FIGS. 17 and 18, the tab 1013 has a simple rectangular shape and is integrally formed with the base. Alternatively, the tabs may comprise separate components fixed to the base edge by a weld or adhesive. In the embodiment shown in FIG. 19, the tab 1035 has a rectangular base portion 1035*a* and a radially-projecting ear 1035*b* formed at the tab's distal end. In both embodiments, the tabs 1033, 1035 prevent the lid from sliding laterally on the rim 9 of the glass 4 but permit the lid to be easily lifted off the glass 4.

Figure 20:
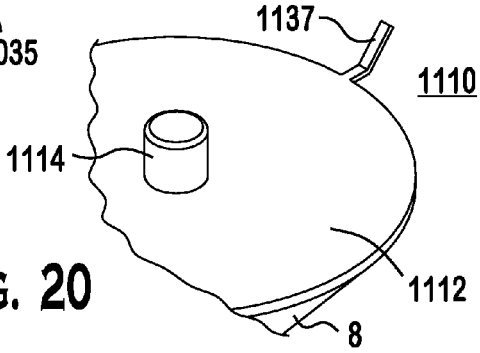
FIGS. 20 and 21 are fragmentary, perspective views of further preferred embodiments of the invention showing secondary lid handles.
Figure 21:
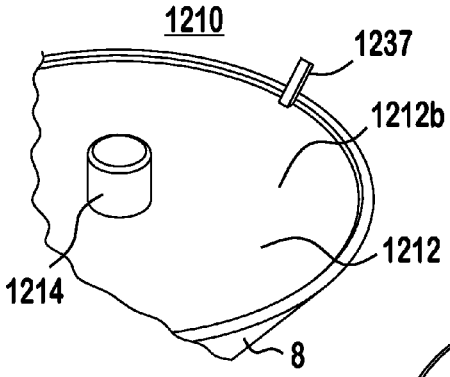
Figure 22:
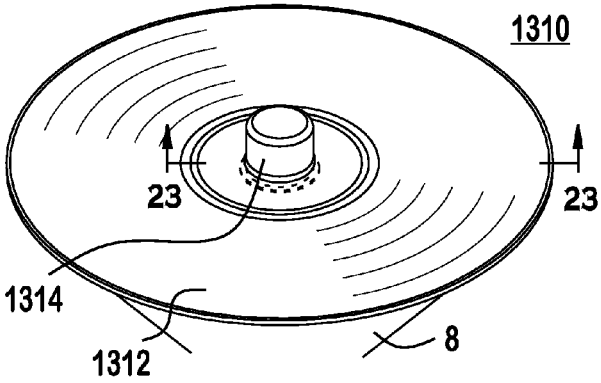
FIG. 22 is a perspective view of yet another preferred embodiment of the invention showing a removable central handle.
Figure 23:
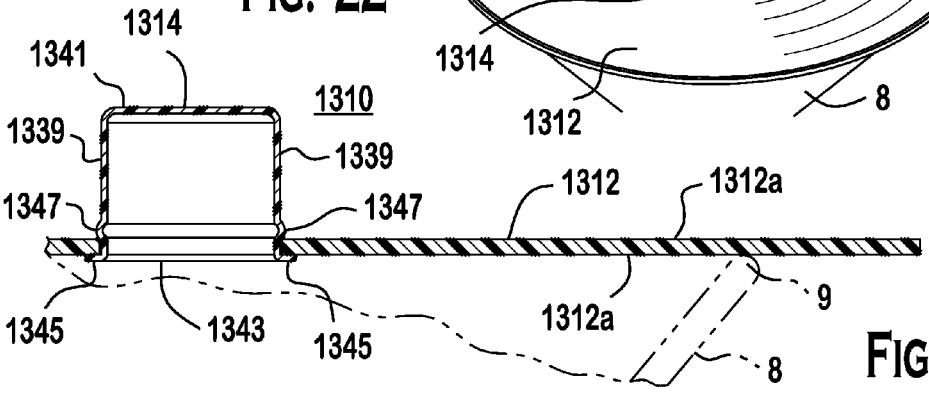
FIG. 23 is a fragmentary, cross-sectional view taken along lines 23-23 of FIG. 22.

A drink lid in accordance with still an additional preferred embodiment of the invention is illustrated in FIG. 20 is designated generally by reference numeral 1110. The lid 1110 has a flat, circular base 1112 similar to the base 112 of FIGS. 1-6, and a central handle 1114 similar to the handle 314 of FIG. 9. In this embodiment, the base 1112 includes a secondary handle 1137 projecting from the edge of the base 1112 A drink lid in accordance with yet another preferred embodiment of the invention is illustrated in FIG. 21 and is designated generally by reference numeral 1210. The lid 1210 has a flat, circular base 1212 and a central handle 1214 similar to the base 312 and handle 314, respectively, of FIG. 9. In this embodiment, the base 1212 includes a secondary handle 1237 projecting from the outer surface 1212*b* of the base 1212. A drink lid in accordance with yet an additional preferred embodiment of the invention is illustrated in FIGS. 22 and 23, and is designated generally by reference numeral 1310. The lid 1310 has a flat, circular base 1312 and a central handle 1314. In this embodiment, the base comprises a standard digital compact storage disc (CD). The handle 1314 comprises a cylindrical button that is removably fixed in the central bore of the CD. The handle 1314 has cylindrical side wall 1339, a generally-flat, circular distal end wall 1341, and a generally-flat, circular proximal end wall 1343, which has a radially-projecting flange 1345 fixed to its perimeter. An annular, radially-projecting rib 1347 is formed in the side wall 1339. The rib 1347 is compressible and functions like a detent. During installation of the handle, the rib 1347 compresses and expands as it passes through the central bore. Once the handle is fully inserted through the bore, the rib 1347 abuts the outer surface 1312*b* of the base 1312 and the flange 1345 abuts the inner surface 1312*a*. In combination, the rib 1347 and flange 1345 lock the handle 1314 to the base 1312.

In this embodiment, the base is used as a promotional item with music and/or video stored on the CD. The central handle is removable by simply by pushing downwardly on the handle until the rib 1347 compresses and releases its locking engagement with the CD. Thereafter, the patron can insert the CD into a CD or DVD player on his/her computer or home entertainment player. It should be appreciated that any of the preceding or following embodiments illustrated and described herein could also include advertising imprinted, labeled or embossed thereon without departing from the scope of the invention.

Figure 24:
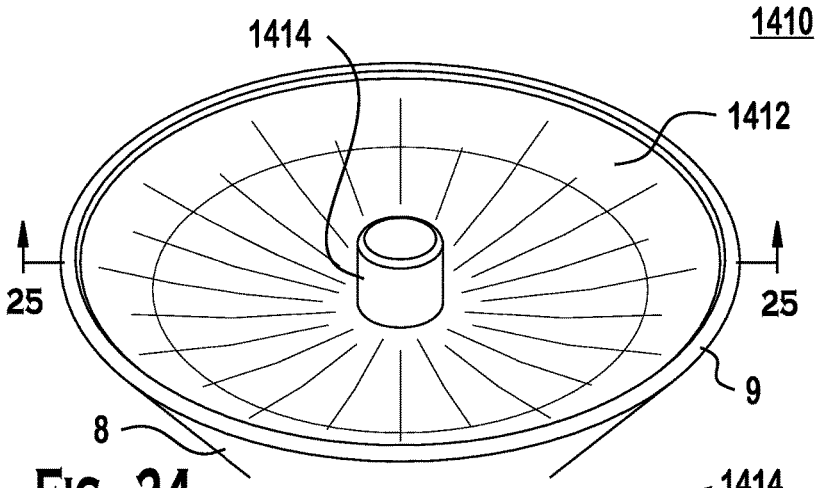
FIG. 24 is a perspective view of yet an additional preferred embodiment of the invention showing concave base.
Figure 25:
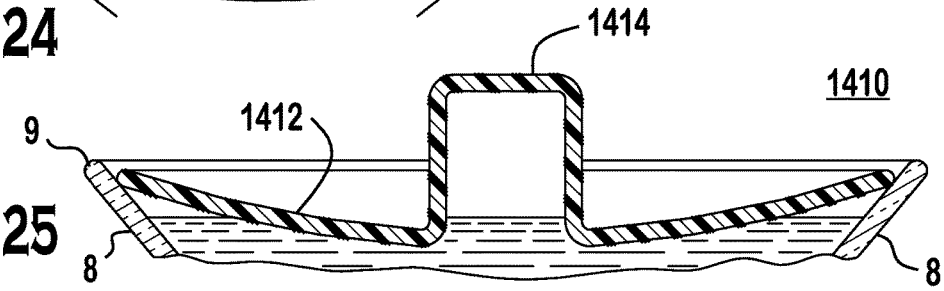
FIG. 25 is a cross-sectional view taken along lines 25-25 of FIG. 24.

A drink lid in accordance with yet another preferred embodiment of the invention is illustrated in FIGS. 24 and 25, and is designated generally by reference numeral 1410. The lid 1410 has a flat, circular base 1412, similar to the base 112 shown in FIG. 7, and an integrally-formed central handle 1414, similar to the handle 314 shown in FIG. 9. In this embodiment, the base 1412 has a diameter slightly smaller than the rim diameter of the martini glass with which it is intended to be used. The base 1412 is made from a flexible material so that it can be depressed into a concave shape, relative to the glass rim, as best seen in FIG. 25. In this embodiment, the lid 1410 can be depressed into contact with the beverage within the reservoir 4 to inhibit the beverage from sloshing and spilling. Alternatively, the lid of this embodiment could be made from a more rigid plastic material that has been formed into the concave shape (relative to the rim of the glass) shown in FIG. 25.

Figure 26:
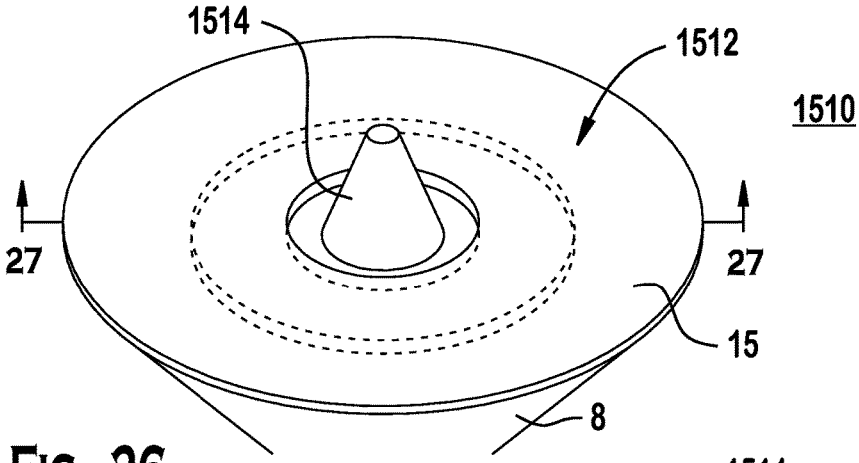
FIG. 26 is a perspective view of yet a further preferred embodiment of the invention for use with a plurality of differently-sized glasses.
Figure 27:
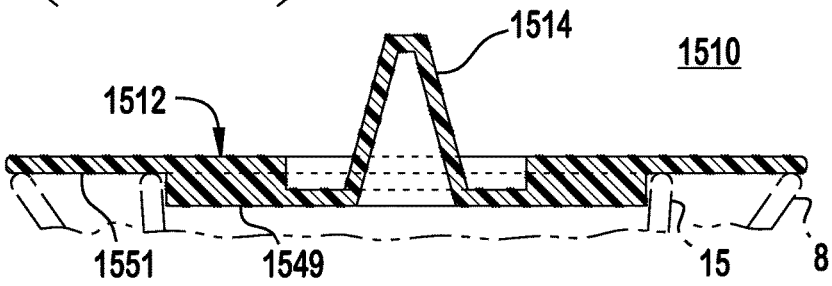
FIG. 27 is a cross-sectional view taken along lines 27-27 of FIG. 26.

A drink lid in accordance with still another preferred embodiment of the invention is illustrated in FIGS. 26 and 27, and is designated generally by reference numeral 1510. In this embodiment, the lid 1510 has a circular stepped base 1512, which is formed by the joinder of two, concentric, planar, circular base plates 1549, 1551, having different inner and outer diameters. Similar to the embodiment shown in FIGS. 1-8, the handle 1514 is integrally formed with the inner base plate 1549.

The lid 1510 of this embodiment is designed to cover two different types or size of glasses. As seen in FIG. 27, the inner base plate 1549 has an outer diameter slightly smaller than the diameter of the rim of a "rocks" glass 15. The outer base plate 1551 has an outer diameter slightly larger than the diameter of the rim 9 of a martini glass 8.

Figure 28:
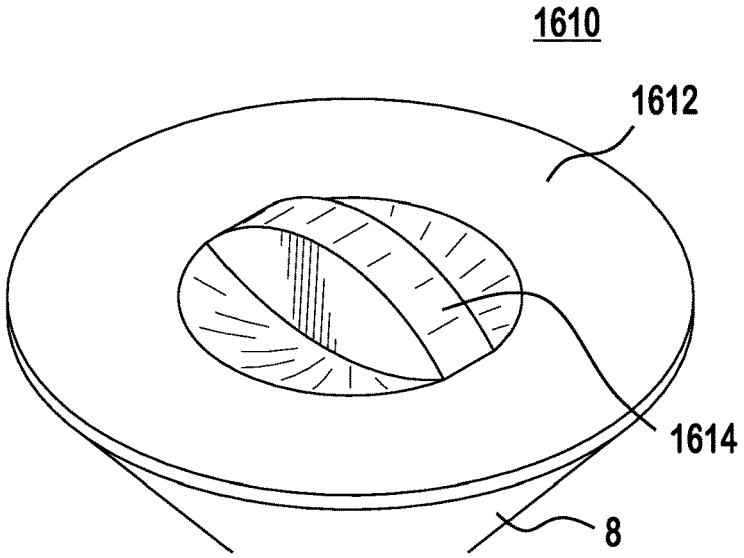
FIG. 28 is a perspective view of still another preferred embodiment of the invention showing an enlarged, central handle.
Figure 29:
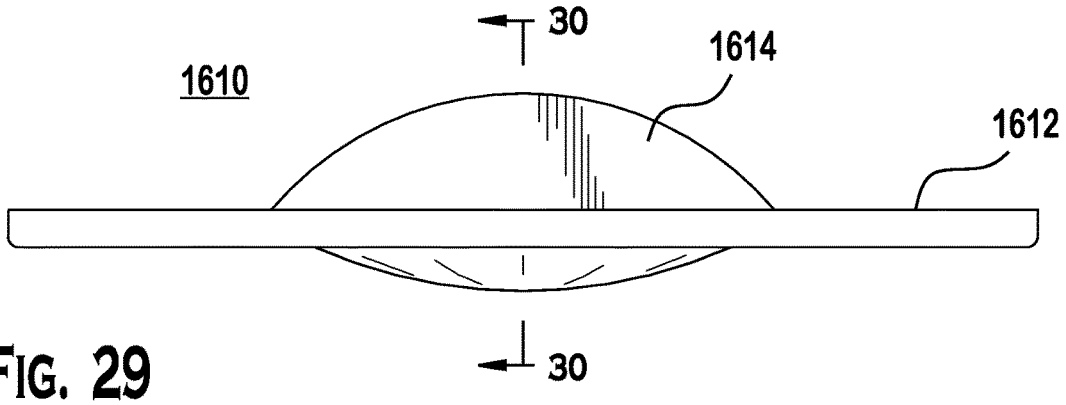
FIG. 29 is a side elevation of the embodiment of FIG. 28.
Figure 30:
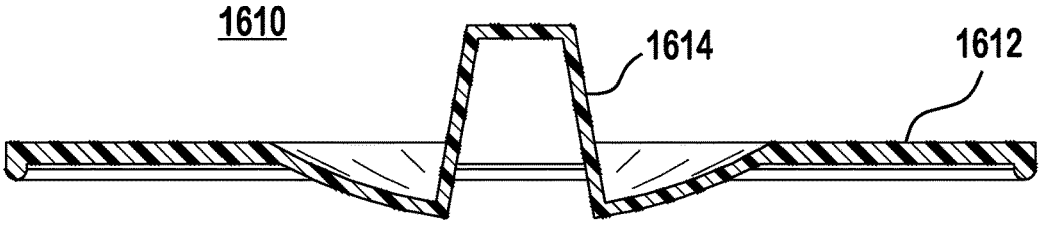
FIG. 30 is a cross-sectional view taken along lines 30-30 of FIG. 29.

A drink lid in accordance with still an additional preferred embodiment of the invention is illustrated in FIGS. 28-30, and is designated, generally by reference numeral 1610. In this embodiment, the lid 1610 has a circular base 1612 and an integrally-formed, central handle 1614. Similar to the embodiment shown in FIGS. 1-6, the handle has a shape that is nestable with the handle of an abutting lid 1610. Because the base is generally flat, and the handle has a nestable shape, the lids 10 can be stacked for compact storage. Preferably, the thickness of the handle creates a gap between abutting adjacently-stacked lids so that the lids can be more easily separated from the stack by inserting an object or finger into the gap.

In still a further preferred embodiment, the invention comprises a drink set comprising any one or more of the above-described lids combined with an appropriately-sized martini glass. In some embodiments, the diameter of the lid is larger enough to cover the entire rim. In other embodiments, the diameter of the lid is small enough to sit within the reservoir of the glass. In still other embodiments, the lid has a tapered edge wherein the angle of the taper relative to the central axis of the base approximates the angle formed between the inner surface of the reservoir and the stem of the glass.

It is to be understood that the description and specific examples, while indicating exemplary embodiments, are given by way of illustration and are not intended to limit the present invention. Various changes and modifications within the present invention will become apparent to the skilled artisan from the discussion and disclosure contained herein, and thus are considered part of the invention. For example, the various features of the numerous embodiments may be combined in any manner desired to enhance the functionality of the lid.

The invention claimed is:

1. A stackable lid for a drinking glass having a reservoir with a circular rim, comprising:

a) a circular, planar base having an outer surface, an inner surface, and an annular lip on the inner surface of said base that projects transverse to the plane of said base; and, b) a central handle affixed at a proximal end to and projecting from said base and having an outer, grasping surface and an inner surface, said handle comprising a shape that allows the outer surface of one handle to nest in the inner surface of the handle of another of said stackable lids;

wherein said lip has a hemispherical cross-section and is located on the outer circumference of said base;

wherein the outer surface of said handle is integrally formed with the outer surface of said base and said inner surface of said handle is integrally formed with the inner surface of said base; and, wherein said base includes a central axial bore and said handle is affixed to the perimeter of said bore and extends axially from said bore.

2. The stackable lid recited in claim 1, wherein said lid has a central axis extending through the center perpendicular to the plane of the base, and the outer edge of the base has a flat, tapered surface that extends outwardly such that the diameter of the outer surface of the base is larger than the diameter of the inner surface.

3. The stackable lid recited in claim 1, including decorative garnish affixed to a distal end of the handle.

4. The stackable lid recited in claim 1, including a plurality of concavities in the outer surface of the base.

5. The stackable lid recited in claim 1, including a cut-out in the base proximate the outer edge.

6. The stackable lid recited in claim 1, including a small bracket protruding radially from the outer edge of the base, said bracket including a pair of deflectable forks that straddle and support a toothpick.

7. The stackable lid recited in claim 1, including a plurality of axially-extending tabs having a distal end and proximal end fixed to the edge of the base.

8. The stackable lid recited in claim 7, including a radially-extending ear on the distal end of each tab, and a secondary handle fixed to said base.

9. The stackable lid recited in claim 1, wherein said base is flexible and can be depressed by applying an axial force to the central handle.

10. A drink set comprising a drinking glass having a base, an enlarged, inverted-conical-shaped reservoir with an upper rim, and an elongate stem connecting the reservoir to the base, and a drink lid having:

a) a circular, planar lid base including an outer surface, an inner surface, and an annular lip on the inner surface of said base that projects transverse to the plane of said base; and, b) a central handle projecting from said base and having an outer, grasping surface and an inner surface, said handle comprising a shape that allows the outer surface of one handle to nest in the inner surface of the handle of another of said lids;

wherein said lip has a hemispherical cross-section and is located on the outer circumference of said base;

wherein the outer surface of said handle is integrally formed with the outer surface of said base and said inner surface of said handle is integrally formed with the inner surface of said base; and wherein said base includes a central axial bore and said handle is affixed to the perimeter of said bore and extends axially from said bore.

11. The drink set recited in claim 10, wherein said lid has a diameter greater than the diameter of the glass rim.

12. The drink set recited in claim 10, said lid base having a flat, tapered edge surface that extends upwardly outwardly relative to a central axis extending perpendicularly through the center of the lid, wherein the angle between the tapered edge surface and the central axis approximates the angle formed between the inner surface of the reservoir and the stem of the glass.

* * * * *